US005551522A

United States Patent [19]

Keith et al.

[11] Patent Number: 5,551,522

[45] Date of Patent: Sep. 3, 1996

[54] DRILL BIT HAVING STABILITY ENHANCING CUTTING STRUCTURE

[75] Inventors: Carl W. Keith, Spring; Graham Mensa-Wilmot, Houston, both of Tex.

[73] Assignee: Smith International, Inc., Houston, Tex.

[21] Appl. No.: 321,942

[22] Filed: Oct. 12, 1994

[51] Int. Cl.[6] ..... E21B 10/36

[52] U.S. Cl. ..... 175/420.2; 175/431

[58] Field of Search ..... 175/420.1, 420.2, 175/413, 431

[56] References Cited

U.S. PATENT DOCUMENTS

| | | | |
|---|---|---|---|
| Re 33,757 | 12/1991 | Weaver | 175/329 |
| Re 34,435 | 11/1993 | Warren et al. | 175/398 |
| 4,429,755 | 2/1984 | Williamson | 175/329 |
| 4,444,281 | 4/1984 | Schumacher et al. | 175/431 X |
| 4,471,845 | 9/1984 | Jürgens | 175/329 |
| 4,475,606 | 10/1984 | Crow | 175/431 |
| 4,545,441 | 10/1985 | Williamson | 175/329 |
| 5,033,560 | 7/1991 | Sawyer et al. | 175/410 |
| 5,131,478 | 7/1992 | Brett et al. | 175/431 X |
| 5,178,222 | 1/1993 | Jones et al. | 175/431 X |
| 5,222,566 | 6/1993 | Taylor et al. | 175/431 |
| 5,238,075 | 8/1993 | Keith et al. | 175/431 |
| 5,265,685 | 11/1993 | Keith et al. | 175/431 |
| 5,346,025 | 9/1994 | Keith et al. | 175/431 X |
| 5,377,773 | 1/1995 | Tibbits | 175/397 |

*Primary Examiner*—Roger J. Schoeppel

*Attorney, Agent, or Firm*—Gregory L. Maag; Conley, Rose & Tayon, P.C.

[57] ABSTRACT

A fixed cutter drill bit includes a cutting structure having radially-spaced sets of cutter elements. The cutter element sets preferably overlap in rotated profile and include at least one low profile cutter element and at least two high profile elements. The low profile element is mounted so as to have a relatively low exposure height. The high profile elements are mounted at exposure heights that are greater than the exposure height of the low profile element, and are radially spaced from the low profile element on the bit face. The high profile elements may be mounted at the same radial position but at differing exposure heights, or may be mounted at the same exposure heights but at different radial positions relative to the bit axis. Providing this arrangement of low and high profile cutter elements tends to increase the bit's ability to resist vibration and provides an aggressive cutting structure, even after significant wear has occurred.

22 Claims, 4 Drawing Sheets

FIG. 3
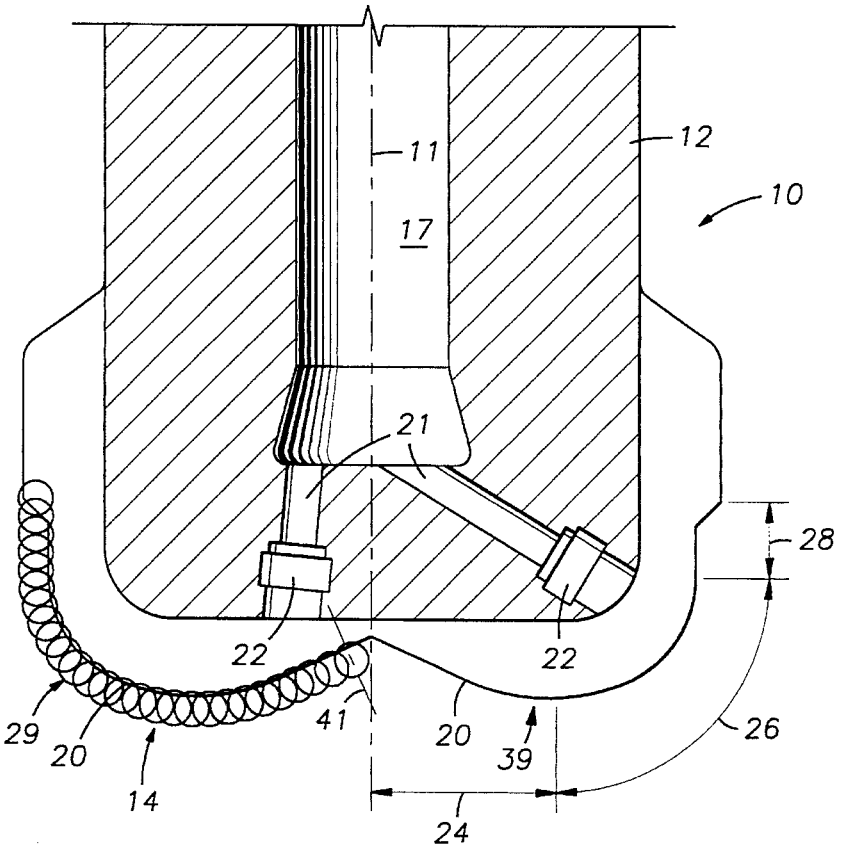
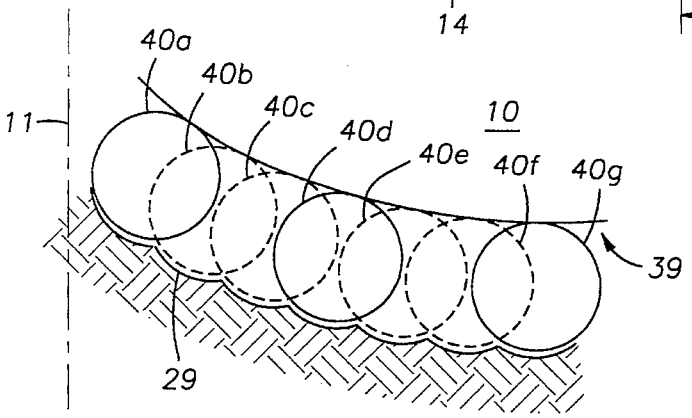
FIG. 4
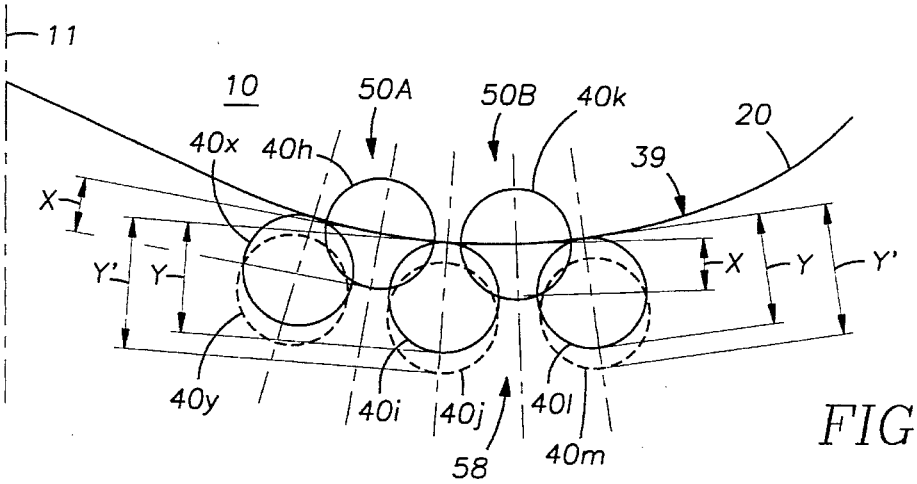
FIG. 5

DRILL BIT HAVING STABILITY ENHANCING CUTTING STRUCTURE

FIELD OF THE INVENTION

This invention relates generally to fixed cutter drill bits of the type typically used in cutting rock formation such as used in drilling an oil well or the like. More particularly, the invention relates to bits utilizing polycrystalline diamond cutting elements that are mounted on the face of the drill bit, such bits typically referred to as "PDC" bits.

BACKGROUND OF THE INVENTION

In drilling a borehole in the earth, such as for the recovery of hydrocarbons or for other applications, it is conventional practice to connect a drill bit on the lower end of an assembly of drill pipe sections which are connected end-to-end so as to form a "drill string." The drill string is rotated by apparatus that is positioned on a drilling platform located at the surface of the borehole. Such apparatus tums the bit and advances it downwardly, causing the bit to cut through the formation material by either abrasion, fracturing, or shearing action, or through a combination of all cutting methods. While the bit is rotated, drilling fluid is pumped through the drill string and directed out of the drill bit through nozzles that are positioned in the bit face. The drilling fluid is provided to cool the bit and to flush cuttings away from the cutting structure of the bit. The drilling fluid and cuttings are forced from the bottom of the borehole to the surface through the annulus that is formed between the drill string and the borehole.

Many different types of drill bits and bit cutting structures have been developed and found useful in drilling such boreholes. Such bits include fixed cutter bits and roller cone bits. The types of cutting structures include milled tooth bits, tungsten carbide insert ("TCI") bits, PDC bits, and natural diamond bits. The selection of the appropriate bit and cutting structure for a given application depends upon many factors. One of the most important of these factors is the type of formation that is to be drilled, and more particularly, the hardness of the formation that will be encountered. Another important consideration is the range of hardnesses that will be encountered when drilling through layers of differing formation hardness.

Depending upon formation hardness, certain combinations of the above-described bit types and cutting structures will work more efficiently and effectively against the formation than others. For example, a milled tooth bit generally drills relatively quickly and effectively in soft formations, such as those typically encountered at shallow depths. By contrast, milled tooth bits are relatively ineffective in hard rock formations as may be encountered at greater depths. For drilling through such hard formations, roller cone bits having TCI cutting structures have proven to be very effective. For certain hard formations, fixed cutter bits having a natural diamond cutting structure provide the best combination of penetration rate and durability. In formations of soft and medium hardness, fixed cutter bits having a PDC cutting structure have been employed with varying degrees of success.

The cost of drilling a borehole is proportional to the length of time it takes to drill the borehole to the desired depth and location. The drilling time, in turn, is greatly affected by the number of times the drill bit must be changed, in order to reach the targeted formation. This is the case because each time the bit is changed, the entire drill string—which may be miles long—must be retrieved from the borehole section by section. Once the drill string has been retrieved and the new bit installed, the bit must be lowered to the bottom of the borehole on the drill string which must be reconstructed again, section by section. As is thus obvious, this process, known as a "trip" of the drill string, requires considerable time, effort and expense. Accordingly, it is always desirable to employ drill bits which will drill faster and longer and which are usable over a wider range of differing formation hardnesses.

The length of time that a drill bit may be employed before the drill string must be tripped and the bit changed depends upon the bit's rate of penetration ("ROP"), as well as its durability or ability to maintain a high or acceptable ROP. Additionally, a desirable characteristic of the bit is that it be "stable" and resist vibration. The most severe type or mode of vibration is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes the premature wearing or destruction of the cutting elements and a loss of penetration rate.

In recent years, the PDC bit has become an industry standard for cutting formations of soft and medium hardnesses. The cutter elements used in such bits are formed of extremely hard materials and include a layer of thermally stable polycrystalline diamond material. In the typical PDC bit, each cutter element or assembly comprises an elongate and generally cylindrical support member which is received and secured in a pocket formed in the surface of the bit body. A disk or tablet-shaped, preformed cutting element having a thin, hard cutting layer of polycrystalline diamond is bonded to the exposed end of the support member, which is typically formed of tungsten carbide. Although such cutter elements historically were round in cross section and included a disk shaped PDC layer forming the cutting face of the element, improvements in manufacturing techniques have made it possible to provide cutter elements having PDC layers formed in other shapes as well.

A common arrangement of the PDC cutting elements was at one time to place them in a spiral configuration. More specifically, the cutter elements were placed at selected radial positions with respect to the central axis of the bit, with each element being placed at a slightly more remote radial position than the preceding element. So positioned, the path of all but the center-most elements partly overlapped the path of movement of a preceding cutter element as the bit was rotated. Thus, each element would remove a lesser volume of material than would be the case if it were radially positioned so that no overlapping occurred, or occurred to a lesser extent, because the leading cutter element would already have removed some formation material from the path being traveled by the following cutter element. Using this arrangement of cutters, each cutter tended to remove a comparatively small amount of material from the formation during each revolution, and was subjected to substantially the same loading as the other cutter elements on the bit face.

Although the spiral arrangement was once widely employed, this arrangement of cutter elements was found to wear in a manner to cause the bit to assume a cutting profile that presented a relatively flat and single continuous cutting edge from one element to the next. Not only did this decrease the ROP that the bit could provide, it but also increased the likelihood of bit vibration. Both of these conditions are undesirable. A low ROP increases drilling time and cost, and may necessitate a costly trip of the drill string in order to replace the dull bit with a new bit. Excessive bit vibration will itself dull the bit or may damage the bit to an extent that a premature trip of the drill string again becomes necessary.

Thus, in addition to providing a bit capable of drilling effectively at desirable ROP's through a variety of formation hardnesses, preventing bit vibration and maintaining stability of PDC bits has long been a desirable goal, but one which has not always been achieved. Bit vibration may occur in any type of formation, but is most detrimental in the harder formations. As described above, the cutter elements in many prior art PDC bits were positioned in a spiral relationship which, as drilling progressed, wore in a manner which caused the ROP to decrease and which also increased the likelihood of bit vibration.

There have been a number of designs proposed for PDC cutting structures that were meant to provide a PDC bit capable of drilling through a variety of formation hardnesses at effective ROP's and with acceptable bit life or durability. For example, U.S. Pat. No. 5,033,560 (Sawyer et at.) describes a PDC bit having mixed sizes of PDC cutter elements which are arranged in an attempt to provide improved ROP while maintaining bit durability. The '560 patent is silent as to the ability of the bit to resist vibration and remain stable. Similarly, U.S. Pat. No. 5,222,566 (Taylor et at.) describes a drill bit which employs PDC cutter elements of differing sizes, with the larger size elements employed in a first group of cutters, and the smaller size employed in a second group, This design, however, suffers from the fact that the cutter elements do not share the cutting load equally. Instead, the blade on which the larger sized cutters are grouped is loaded to a greater degree than the blade with the smaller cutter elements. This could lead to blade failure. U.S. Pat. No. Re 33,757 (Weaver) describes still another cutting structure having a first row of relatively sharp, closely-spaced cutter elements, and a following row of widely-spaced, blunt or rounded cutter elements for dislodging the formation material between the kerfs or grooves that are formed by the sharp cutters. While this design was intended to enhance drilling performance in formations classified as medium-soft to medium, this bit includes no features directed toward stabilizing the bit once wear has commenced. Further, the bit's cutting structure has been found to limit the bit's application to relatively brittle formations.

Separately, other attempts have been made at solving bit vibration and increasing stability. For example, U.S. Pat. No. Re 34,435 (Warren et al.) describes a bit intended to resist vibration that includes a set of cutters which are disposed at an equal radius from the center of the bit and which extend further from the bit face than the other cutters on the bit. According to that patent, the set of cutters extending furthest from the bit face are provided so as to cut a circular groove within the formation. By design, the extending cutters ride in the groove which tends to stabilize the bit. Similarly, U.S. Pat. No. 5,265,685 (Keith et at.) discloses a PDC bit that is designed to cut a series of grooves in the formation such that the resulting ridges formed between each of the concentric grooves tend to stabilize the bit. U.S. Pat. Re 34,435 and 5,265,685 both disclose using the same sized cutter elements. U.S. Pat. No. 5,238,075 (Keith et at.) also describes a PDC bit having a cutter element arrangement which employs cutter elements of different sizes and which, in part, was hoped to provide greater stabilization.

Unfortunately, however, many of these designs aimed at minimizing vibration required that drilling be conducted with an increased weight-on-bit ("WOB") as compared with bits of earlier designs. Drilling with an increased or heavy WOB has serious consequences and is avoided whenever possible. Increasing the WOB is accomplished by adding additional heavy drill collars to the drill string. This additional weight increases the stress and strain on all drill string components, causes stabilizers to wear more quickly and to work less efficiently, and increases the hydraulic pressure drop in the drill string, requiring the use of higher capacity (and typically higher cost) pumps for circulating the drilling fluid.

Thus, despite attempts and certain advances made in the art, there remains a need for a fixed cutter bit having an improved cutter arrangement which will permit the bit to drill effectively at economical ROP's and, ideally, to drill in formations having a hardness greater than that in which conventional PDC bits can be employed. More specifically, there is a need for a PDC bit which can drill in soft, medium, medium hard and even in some hard formations while maintaining an aggressive cutter profile so as to maintain high ROP's for acceptable lengths of time and thereby lower the drilling costs presently experienced in the industry. Such a bit should also provide an increased measure of stability as wear occurs on the cutting structure of the bit so as to resist bit vibration. Ideally, the increased stability of the bit should be achieved without having to employ substantial additional WOB and suffering from the costly consequences which arise from drilling with such extra weight.

SUMMARY OF THE INVENTION

Accordingly, there is provided herein a drill bit particularly suited for drilling through a variety of formation hardnesses with normal WOB at improved penetration rates while maintaining stability and resisting bit vibration. The bit may be successfully employed in formations of greater hardness than can typically be drilled using conventional PDC bits.

The bit generally includes a cutting structure having spaced apart groups or sets of cutter elements mounted on the bit face. The cutter elements in each set are likewise spaced apart along the bit face. Each set includes a cutting profile that is defined by the cutting profiles of the cutter elements in the set when viewed in rotated profile. The cutter element sets preferably overlap in rotated profile and include at least one low profile cutter element and at least two high profile elements. The low profile element is mounted so as to have a relatively low exposure height. The high profile elements are mounted at exposure heights that are greater than the exposure height of the low profile element, and are radially spaced from the low profile element on the bit face. The high profile elements may be mounted at the same radial positions but at differing exposure heights, or may be mounted at the same exposure heights but at different radial positions relative to the bit axis.

In embodiments where the high profile elements are radially aligned but mounted at differing exposure heights, the exposure variance is preferably at least about 0.02 inches. Where the high profile elements are mounted with exposure heights that are substantially the same, they may be, for example, radially spaced at least about 0.050 inches.

Any practical number of cutter elements may be mounted in redundant positions to the low and high profile elements in a set. Further, depending upon the hardness and composition of the formation that is to be drilled, as well as other factors, the cutter elements employed may have cutting profiles of various sizes and shapes. For example, in certain situations, it may be desirable to have a first set of cutter elements having round cutting profiles and a second set having scribe cutters with pointed cutting profile. Likewise, the sizes and shapes of the cutter elements within any set may be varied. For example, it may be desirable to employ two or more scribe shaped cutters in a set and position a round cutter element in the same set. In other applications, it may be desirable to have set which include cutter elements having similarly shaped cutting faces of varying sizes.

As the bit rotates in the borehole, portions of the cutting profile of various cutter elements in each set are partially hidden from the formation material by other cutter elements in the same set. As the bit wears, the regions of multiple diamond density remain well-defined in rotated profile and suffer from less wear than the adjacent regions having lesser diamond densities. Thus, the bit face presents varying cutter exposures heights and varying diamond densities. These features creates different wear gradients along the bit cutting structure profile. As drilling progresses, this design creates a pattern of alternating grooves and ridges in the formation material tending to stabilize the bit, without requiting the increased WOB as was often necessary to drill with prior art bits where increased stability was desired.

Thus, the present invention comprises a combination of features and advantages which enable it to substantially advance the drill bit art by providing a cutting structure and drill bit for effectively and efficiently drilling through a variety of formation hardnesses at economic rates of penetration and with superior bit durability. The bit drills more economically than many prior art PDC bits, and drills with less vibration and greater stability, even after substantial wear has occurred to the cutting structure of the bit. Further, drilling with the bit does not also require additional or excessive WOB. These and various other characteristics and advantages of the present invention will be readily apparent to those skilled in the art upon reading the following detailed description of the preferred embodiments of the invention, and by referring to the accompanying drawings.

BRIEF DESCRIPTION OF THE DRAWINGS

For a detailed description of the preferred embodiment of the invention, reference will now be made to the accompanying drawings, wherein:

FIG. 3 is an elevational view, partly in cross-section, of the drill bit shown in FIG. with the cutter elements shown in rotated profile collectively on one side of the central axis of the drill bit.

FIG. 4 is an enlarged view of a portion of FIG. 3 showing the overlapping of the cutting profiles of the cutter elements that are located adjacent to the bit axis.

FIG. 5 is an enlarged view similar to FIG. 4 showing schematically, in rotated profile, the relative positions of certain of the cutter elements and cutter element sets that are mounted on the drill bit shown in FIG. 1.

DESCRIPTION OF THE PREFERRED EMBODIMENT

Figure 1:
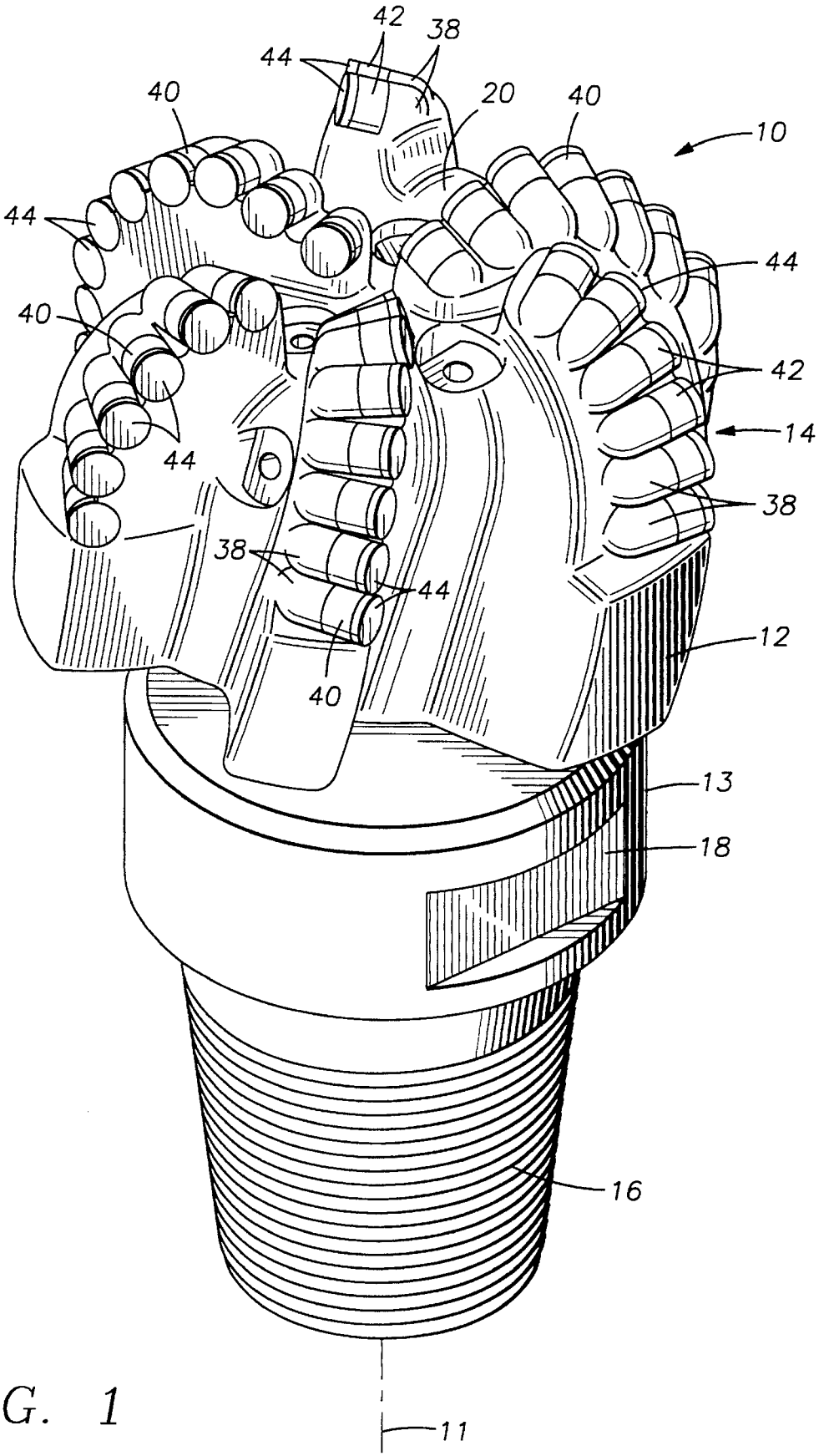
FIG. 1 is a perspective view of a drill bit made in accordance with the present invention.
Figure 2:
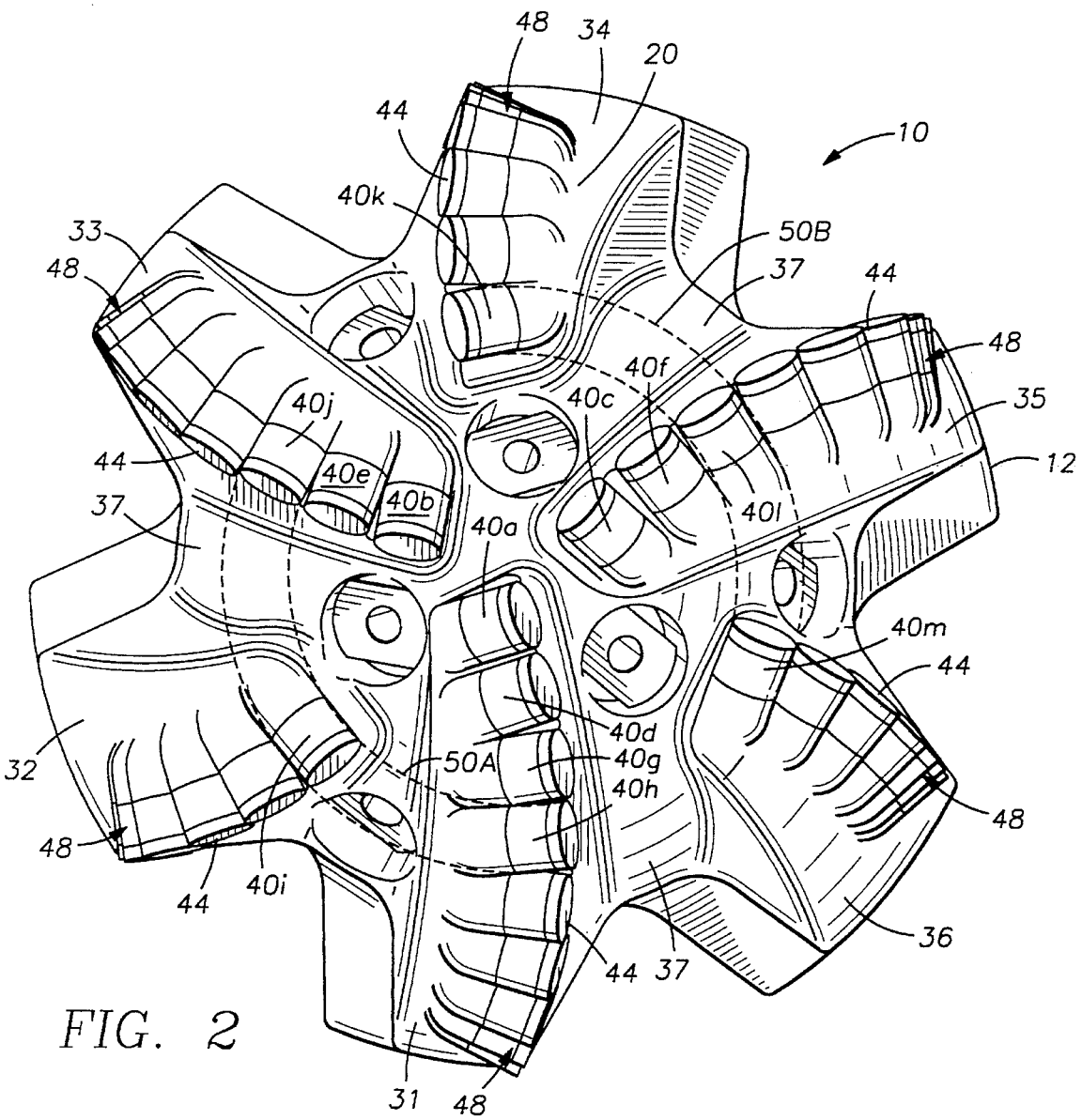
FIG. 2 is a plan view of the cutting end of the drill bit shown in FIG. 1.

A drill bit 10 embodying the features of the present invention is shown in FIGS. 1–3. Bit 10 is a fixed cutter bit, sometimes referred to as a drag bit, and is adapted for drilling through formations of rock to form a borehole. Bit 10 generally includes a bit body 12, shank 13, and threaded connection or pin 16 for connecting bit 10 to a drill string (not shown) which is employed to rotate the bit for drilling the borehole. Bit 10 further includes a central axis 11 and a cutting structure 14 preferably including various PDC cutter elements 40.

Body 12 includes a central longitudinal bore 17 (FIG. 3) for permitting drilling fluid to flow from the drill string into the bit. A pair of oppositely positioned wrench flats 18 (one shown in FIG. 1) are formed on the shank 13 and are adapted for fitting a wrench to the bit to apply torque when connecting and disconnecting bit 10 from the drill string.

Bit body 12 includes a bit face 20 which is formed on the end of the bit 10 that is opposite pin 16 and which supports cutting structure 14, described in more detail below. Body 12 is formed in a conventional manner using powdered metal tungsten carbide particles in a binder material to form a hard metal cast matrix. Steel bodied bits, those machined from a steel block rather than a formed matrix, may also be employed in the invention. In the preferred embodiment shown, bit face 20 includes six angularly spaced-apart blades 31–36 which are integrally formed as part of and which extend from body 12. Blades 31–36 include blade profiles 39 (FIG. 3) on which cutter elements 40 are mounted as described in more detail below. Blades 31–36 extend radially across the bit face 20 and longitudinally along a portion of the periphery of the bit, and are separated by grooves which define drilling fluid flow courses 37 between and along the cutting faces 44 of the cutter elements 40. Again in the preferred embodiment shown in FIG. 2, blades 31, 33 and 35 are equally spaced 120° apart, while blades 32, 34 and 36 lag behind blades 31, 33 and 35 by 55°. Given this angular spacing, blades 31–36 may be considered to be divided into pairs of "leading" and "lagging" blades, a first such blade pair comprising blades 31 and 32, a second pair comprising blades 33 and 34, and a third pair including blades 35 and 36.

As best shown in FIG. 3, body 12 is also provided with downwardly extending flow passages 21 having nozzles 22 disposed at their lowermost ends. In the preferred embodiment, bit 10 includes six such flow passages 21 and nozzles 22. The flow passages 21 are in fluid communication with central bore 17. Together, passages 21 and nozzles 22 serve to distribute drilling fluids around the cutter elements 40 for flushing formation cuttings from the bottom of the borehole and away from the cutting faces 44 of cutter elements 40 when drilling.

Referring still to FIG. 3, to aid in an understanding of the more detailed description which follows, blade profiles 39 and bit face 20 may be said to be divided into three different zones or regions 24, 26, 28. The central portion of the bit face 20 is identified by the reference numeral 24 and may be concave as shown. Adjacent central portion 24 is the shoulder or the upturned curved portion 26. Next to shoulder portion 26 is the gage portion 28, which is the portion of the bit face 20 which defines the diameter or gage of the borehole drilled by bit 10. As will be understood by those skilled in the art, regions 24, 26, 28 are approximate and are identified only for the purposes of better describing the distribution of cutter elements 40 over the blade profiles 39 and bit face 20, as well as certain other inventive features of the present invention.

As best shown in FIG. 1, each cutter element 40 is mounted within a pocket 38 which is formed in the bit face 20 on the blade profile 39 of one of the radially and longitudinally extending blades 31–36. Cutter elements 40 are constructed by conventional methods and each typically includes a base or support member 42 having one end secured within a pocket 38 by brazing or similar means. The support 42 is comprised of a sintered tungsten carbide material having a hardness greater than that of the body matrix material. Attached to the opposite end of the support member 42 is a layer of extremely hard material, preferably a synthetic polycrystalline diamond material which forms the cutting face 44 of element 40. Such cutter elements 40, generally known as polycrystalline diamond composite compacts, or PDC's, are commercially available from a number of suppliers including, for example, Smith Sii Megadiamond, Inc. or General Electric Company, which markets compacts under the trademark "STRATAPAX". Although cutters 40 have thus far been shown and described as generally cylindrical elements, the bit 10 and cutting structure 14 of the present invention is not limited to any particular type of cutter element, and stud cutters having cutting faces mounted on posts or studs that are fixed normal to the bit face may also be employed.

As shown in FIGS. 1 and 2, the cutter elements 40 are arranged in separate rows 48 along the blades 31–36 and are positioned along the bit face 20 in the regions previously described as the central portion 24, shoulder 26 and gage portion 28. Cutter elements 40 are mounted on the profiles 39 of blades 31–36 in selected radial positions relative to the central axis 11 of the bit 10. The cutting faces 44 of the cutter elements 40 are oriented in the direction of rotation of the drill bit 10 so that the cutting face 44 of each cutter element 40 engages the earth formation as the bit 10 is rotated and forced downwardly through the formation.

Referring again to FIGS. 2 and 3, each row 48 includes a number of cutter elements 40 radially spaced from each other relative to the bit axis 11. As is well known in the art, cutter elements 40 are radially spaced such that the groove or kerf formed by the cutting profile of a cutter element 40 overlaps to a degree with kerfs formed by one or more cutter elements 40 of other rows 48. Such overlap is best understood in a general sense by referring to FIG. 4 which schematically shows, in rotated profile, the relative radial positions of the most centrally located cutter elements 40, that is, those elements 40 positioned closest to bit axis 11 which have been identified in FIGS. 2 and 4 with the reference characters *40a–40 g* . As shown, elements *40a*, *40d* and *40g* are radially spaced in a first row 48 on blade 31. As bit 10 is rotated, these elements will cut separate kerfs in the formation material, leaving ridges therebetween. As the bit 10 continues to rotate, cutter elements *40b* and *40c*, mounted on blades 33 and 35, respectively, will cut the ridge that is left between the kerfs made by cutter elements *40a* and *40d*. Likewise, elements *40e* and *40f* (also mounted on blades 33 and 35, respectively) cut the ridge between the kerfs formed by elements *40d* and *40g*. With this radial overlap of cutter 40 profiles, the cutting profile of cutting structure 14 may be generally represented by the relatively smooth curve 29 formed by the outer-most edges of cutting faces 44 of cutters 40 as shown in FIG. 3, which depicts the cutter elements 40 of the bit 10 in rotated profile collectively on one side of central bit axis 11.

As will be understood by those skilled in the art, certain cutter elements 40 are mounted on the bit face 20 at substantially the same radial position and at the same exposure height as other elements 40 and therefore follow in the same swath or kerf cut by a preceding cutter element 40. As used herein, such elements may be referred to as "redundant" cutters. In the rotated profile of FIG. 3, the distinction between such redundant cutter elements cannot be seen.

Further, as explained below, the present invention provides that the cutter elements 40 be arranged and mounted on the bit in groups or sets 50. Within the sets 50, some cutter elements 40 are disposed relatively close together in the radial sense to other cutter elements 40 in the same set, such that when viewed in rotated profile, their cutting profiles are only slightly out of profile with one another. Likewise, within the sets 50, some cutters 40 are mounted at substantially the same radial position but at different exposure heights compared to other cutters in the set 50. These typically small differences in radial position and exposure height of the cutter elements in the sets are not visible in FIG. 3, but are described in more detail below with reference to FIGS. 5–9.

As described above, in addition to being mounted in rows 48, cutter elements 40 in the present invention are also arranged in sets 50, each cutter set 50 including cutter elements 40 from various rows 48. Each cutter set 50 includes at least three cutters 40, but may also include four cutters 40, or any greater number of cutters.

Referring now to FIG. 5, two such cutter element sets 50A, 50B are shown in rotated profile in relation to bit axis 11. Cutter element set 50A includes cutter elements *40h*, *40i*, *40j*, each of which is located on a blade profile 39 of a different blade 31–36. Similarly, 50B includes elements *40k*, *40l* and *40m* which are likewise mounted on different blades from one another. Referring to FIG. 2, cutter sets 50A,B are generally shown enclosed by dashed lines. As shown, elements *40h*, *40i* and *40j* are mounted on blades 31, 32 and 33, respectively. Elements *40k*, *40l* and *40m* are mounted on blades 34, 35 and 36, respectively.

Although this embodiment of the invention is depicted in FIGS. 1 and 2 on a six-bladed bit 10, the principles of the present invention can be employed in bits having any number of blades, and the invention is not limited to a bit having any particular number of blades or angular spacing of the blades. Further, although the arrangement of FIG. 5 shows cutter element *40h–m* in sets 50A,50B each to be positioned on a different blade, depending on the number of cutter elements 40 in the set, the size of the elements, and the desired spacial relationship of the elements, certain cutter elements 40 in adjacent sets 50A, 50B may be positioned on the same blade. For example, cutter elements *40h* and *40k* may be mounted on the same blade. In such example, elements *40i* and *40l* may also be mounted together on a single blade, but would be mounted on a blade that does not also contain elements *40h* and *40k*. Continuing this example further, elements *40j* and *40m* would be positioned together on a third blade.

Referring once again to FIG. 5, cutter elements *40h–m* each have generally circular cutting faces and cutting profiles and, in this example, are identically sized. For example, cutters *40h–m* may all have cutting faces approximately ½inch in diameter. Each set 50 includes at least one "low profile " cutter 40 and at least two "high profile " cutters 40. As used herein, the terms low and high profile refer to the degree that the cutters are exposed to the formation material. Low profile cutters have relatively low mounting heights on the blade profile 39 of bit face 20, and thus are exposed to the formation material to a lesser degree than are the high profile cutters. Referring specifically to FIG. 5, set 50A is shown to include low profile cutter *40h* and high profile cutters *40i*, *40j*. Set 50B includes low profile cutter *40k* and high profile cutters *40l*, *40m*. The low and high profile cutters in a set are radially spaced such that the cutting profile of the low profile element overlaps to some extent with the cutting profile of at least one of the high profile cutters in the same set. Thus, as shown in FIG. 5, the cutting profile of low profile cutter 40*h* overlaps with the cutting profiles of each of the cutters 40*i*, 40*j*. Likewise, cutters 40*k–m* are radially spaced such that the cutting profile of low profile cutter 40*k* overlaps with the cutting profiles of elements 40*l* and 40*m*.

The sum or union of the cutting profiles of all the cutter elements 40 in a set 50 define the cutting profile of the set 50. The invention also contemplates that the cutter elements 40 will be arranged on the bit face 20 such that the cutting profiles of adjacent cutter sets 50 will overlap in rotated profile. Thus, as shown in FIG. 5, the cutting profiles of sets 50A and 50B overlap in an area that is formed by the intersection of the cutting profiles of the high profile cutter elements 40*i*, 40*j* of set 50A and the low profile element 40*k* of set 50B. Likewise, the cutting profile of set 50A overlaps with the cutting profiles of cutter elements 40*x* and 40*y* which form a part of the set 50 immediately adjacent to set 50A on the side closest to the bit axis 11. Although not shown, the cutting profile of set 50B will likewise overlap in rotated profile with the profile of another set 50 (not shown) that is located at a position that is more radially remote than set 50B.

In the embodiment shown in FIG. 5, low profile elements 40*h* and 40*k* each have generally circular cutting faces and profiles, and are mounted so as to have the same exposure height as measured from blade profile 39 of bit face 20. The exposure height of an element 40 is the distance between the blade profile 39 and the point on the cutting profile of the cutter 40 that is furthest from profile 39 when measured normal to profile. Typically, dimension X will be within the range of about 0.05 to 0.50 inches, and preferably is about 0.25 inch in this example where the cutter elements 40*h–m* have circular cutting profiles with diameters equal to about one half inch. The preferred dimension for X will vary proportionately for larger and smaller sized cutters. The high profile elements 40*i, j* and 40*l, m* all have exposure heights that exceed the exposure height of low profile elements 40*h, k*. As shown in this embodiment, the two high profile elements of each set 50A,B are mounted at slightly differing exposure heights. More specifically, elements 40*i* and 40*l* are mounted at heights represented by dimension Y. Elements 40*j* and 40*m* are mounted at slightly greater heights as represented by dimension Y', Y' being larger than Y, and Y being larger than X in this example. In the example depicted, it is preferred that Y be approximately 0.50 inch, and that Y' be approximately 0.525 inch. The exposure variance between Y' and Y should be about 0.025 inch. The exposure variance between Y and X should be about 0.25 inch.

Referring still to FIGS. 1, 2 and 5, as the bit 10 is rotated about its axis 11, the blades 31–36 sweep around the bottom of the borehole causing the cutter elements 40 to each cut a trough or kerf within the formation material. Given this cutter arrangement, the high profile cutters 40*i, j, l, m* will cut relatively deep concentric kerfs in the formation material and form well defined ridges of formation material in the region generally shown by reference numeral 58. These ridges will tend to make the bit highly resistant to lateral movement due to increased side loading provided by the ridges on the cutter elements 40 of sets 50. The bit 10 will thus tend to remain stable and resist bit vibration. At the same time, low profile elements 40*h, 40 k* will cut the formation material that lies in regions 58 between the kerfs that are formed by the high profile elements. With the high profile elements 40*i, j, l, m* mounted at varying exposure heights, bit 10 initially tends to drill as a relatively light set bit as is advantageous in relatively soft formations. Elements 40*j* and 40*m* are more exposed to the formation material than elements 40*i* and 40*l* and, until wear occurs, will hide or protect portions of the cutting faces of elements 40*i*. After wear has occurred to cutters 40*j* and 40*m*, cutters 40*i* and 40*l* become more exposed to formation. Once this occurs, elements 40*i, j, l, m* will all be exposed to substantially the same degree, and the bit 10 will assume the cutting profile and characteristics of a heavy set bit.

Although sets 50A, B are depicted in FIG. 5 as consisting of three elements 40 per set 50, the invention is in no way limited to having only three cutter elements 40 in a set 50. That is, a set 50 may include three, four or more elements 40 in the same set. For example, set 50A shown in FIG. 5 may include redundant cutter elements 40 having the came cutting profiles as elements 40*h–j*. Even more specifically, set 50A may be arranged so as to have three cutter elements mounted so as to have the cutting profile represented by element 40*i*, three other elements 40 mounted so as to have the cutting profile represented by cutter 40*j*, and two cutter elements having the cutting profile represented by cutter element 40*h*. Also, although each set 50 is shown in FIG. 5 to include an equal number of cutter elements 40, the number of cutter elements in the sets 50 may vary on the same bit. For example, at a radial position on the bit face that is subjected to particularly severe loading, it may be desirable to position a greater number of cutter elements 40 in a set 50 than at a radial position that is not as highly loaded. Similarly, the degree or extent of overlap of cutting profiles of elements 40 in sets 50 may be varied from set to set across the bit face 20. For example, the number of cutter elements in a set may increase, and the spacing between radially adjacent sets may decrease upon moving from bit axis 11 toward gage portion 28.

Certain preferred variations or alternative embodiments to the drill bit and cutter arrangement previously described are shown in FIGS. 6–9. In describing these embodiments, similar reference numerals and characters will be used to identify like or common elements.

In certain drilling applications, such as where it is known that the bit will be drilling exclusively through layers of relatively hard formation materials, the feature permitting the bit to initially perform as a light set bit will not be as significant. In such applications, however, high stability is critical to successful drilling operations. Likewise, in drilling through relatively hard formation material, a durable long lasting bit that will maintain high ROP throughout its life will be essential. For these drilling applications, the present invention provides a cutting structure and bit having high profile cutters that are radially out of profile with one another so as to form areas of multiple diamond density that are highly exposed to the formation material, such areas both enhancing bit stability and creating an aggressive cutting profile. Such a cutting structure and bit are best understood with reference to FIG. 6.

Figure 6:
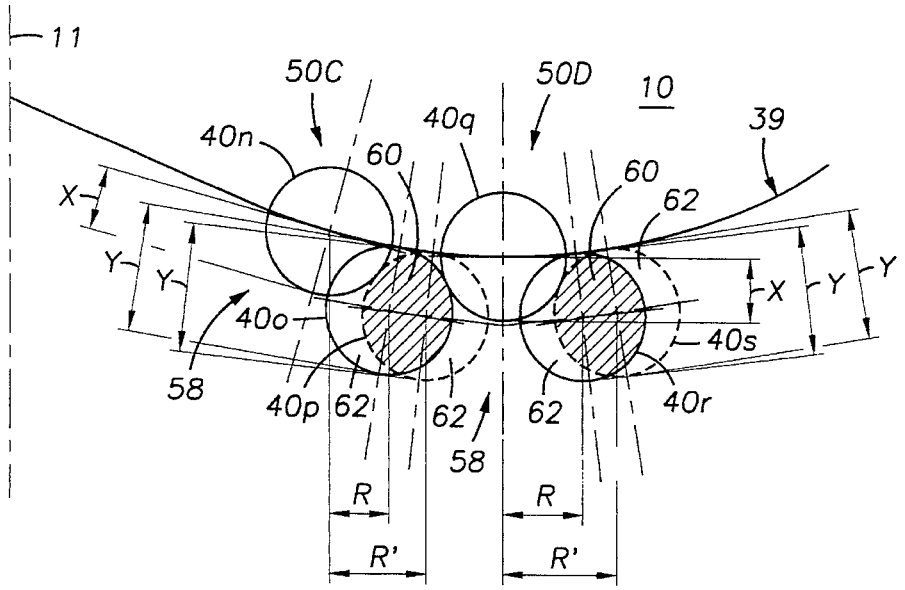
Figure 7:
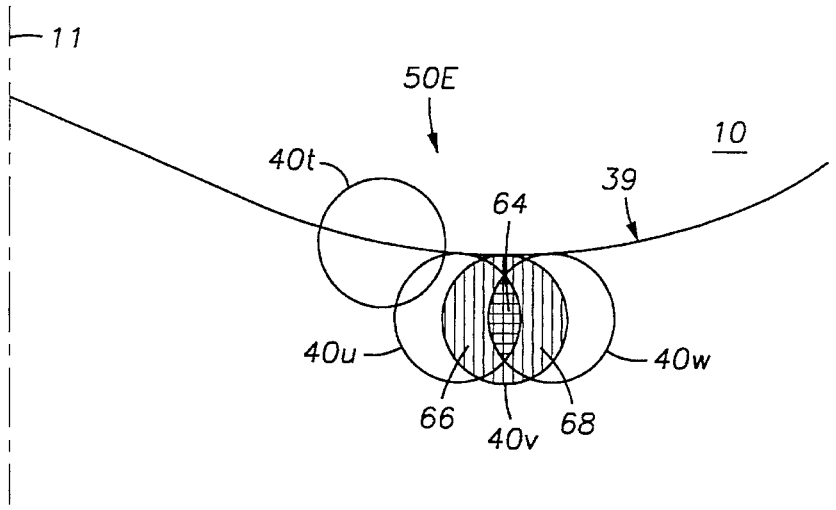

Referring to FIG. 6, cutting structure 14 is shown having radially spaced cutter sets 50C and 50D. Set 50C includes low profile element 40*n* and a pair of high profile elements 40*o*, 40*p*. Low profile element 40*n* is mounted on bit 10 so as to have a exposure height of dimension X, which is again measured normal to blade profile 39 and generally will be within the range of 0.05 to 0.5 inch and preferably is about 0.25 inch for cutter elements 40*n–s* having cutter profiles with diameters of about 0.5 inch. High profile elements 400, 40*p* have the same exposure height Y which is at least about 0.02 inch greater than X. In this embodiment, where X is 0.25 inch and the diameters of the cutting profiles are approximately one half inch, Y is preferably 0.5 inch. Set 50D includes low profile element 40*q* having exposure height X, and two high profile elements 40*r, s*, each of which is mounted at exposure height Y. As shown, although high profile elements 400, 40*p* have the same exposure heights, elements 40*o, p* are radially spaced from low profile element 40*n* by differing dimensions as measured relative to bit axis 11. More specifically, element 400 is spaced from element 40*n* by a distance R, while element 40*p* is spaced apart from element 40*n* by a dimension R', where R' is greater than R. Likewise, in set 50D, elements 40*q* and 40*r* are spaced apart a distance R, while elements 40*q* and 40*s* are spaced apart by a greater distance R'. The dimensions of R and R' will vary, but generally R and R' will differ by at least 0.05 inch. In the example shown in FIG. 6 having cutter elements with one half inch diameter cutting profiles, R' is greater than R by approximately 0.15 inch. Sets 50C,D are radially positioned such that their set cutting profiles overlap in the area of intersection of the cutting profiles of cutter elements 40*p* and 40*q*.

The overlap of cutting profiles of the two high profile cutters 40 in each set 50 form an elongate-shaped region of maximum diamond density 60. In the embodiment of FIG. 6, region 60 has a double diamond density. On each side of region 60 are crescent shaped regions 62 having single diamond density. Regions 60 and 62 all have an exposure heights equal to dimension Y which is greater than exposure height X of low profile elements 40*n, q*. With this cutting structure, as the bit 10 is rotated in the borehole, high profile elements 40*o, p, r, s* form well-defined grooves in the bottom of the borehole which tend to stabilize the bit. As the cutting structure wears, the highly exposed crescent shaped areas 62 of single diamond density will wear relatively quickly compared to the region 60 of double diamond density. As wear continues, the region of double diamond density 60 will continue to form deep grooves in the formation material and thereby continue to stabilize the bit. Also, because of the elongate shape of regions 60, the cutting structure forms an aggressive profile permitting the bit 10 to drill with a high ROP even after significant wear has occurred. Providing this variable diamond density across the span of a set cutting profile, and across the bit face 20, helps the bit maintain an aggressive cutting structure and prolongs the useful life of the bit. Simultaneously, the variable diamond density provides a stabilizing effect on the bit and lessens the likelihood of damaging bit vibration occurring as the bit wears. Stabilization is achieved because as the bit wears, the regions of maximum diamond density 60 remain relatively unworn. These maximum diamond density regions 60 are spaced apart along the bit face such that, in rotated profile, the bit 10 cuts a series of concentric grooves that are separated by well defined ridges that are formed in region 58 between the regions of maximum density 60 of adjacent cutter sets 50.

As should be apparent, cutter sets 50C and 50D may include and preferably do include more than three elements 40 per set. For example, on the six bladed bit 10 shown in FIGS. 1 and 2, set 50C and 50D may each include six cutter elements. With such an arrangement, sets 50C and 50D shown in FIG. 5 may include an additional cutter element 40 in a redundant position to each of cutter elements 40*n–s*. In this arrangement, regions of maximum diamond density 60 would have a quadruple diamond density, while the adjacent crescent-shaped high profile regions 62 would have a double diamond density, as would the circular regions covered by the cutting profiles of low profile cutters 40*n, q*.

Likewise, the ratio of high profile cutters to low profile cutters may be varied within a set 50 to create particularly shaped regions of maximum diamond density 60. For example, referring to FIG. 7, there is shown in rotated profile a cutter set 50E which includes at least four cutters 40*t–w*. Element 40*l* is a low profile cutter mounted with an exposure height that is less than the exposure height of the high profile cutters 40*u, v, w*. Here, high profile cutters 40*u–w* are spaced so as to create a relatively thin and sharp region 64 of maximum diamond density which, in this embodiment will have a triple diamond density formed by the overlapping cutting profiles of all three high profile cutters. The adjacent regions 66, 68 will have double diamond density. In the arrangement where set 50E includes four cutters that are redundant to cutters 40*t–w*, then the diamond densities of regions 64, 66, 68 will be twice that previously described.

Figure 8:
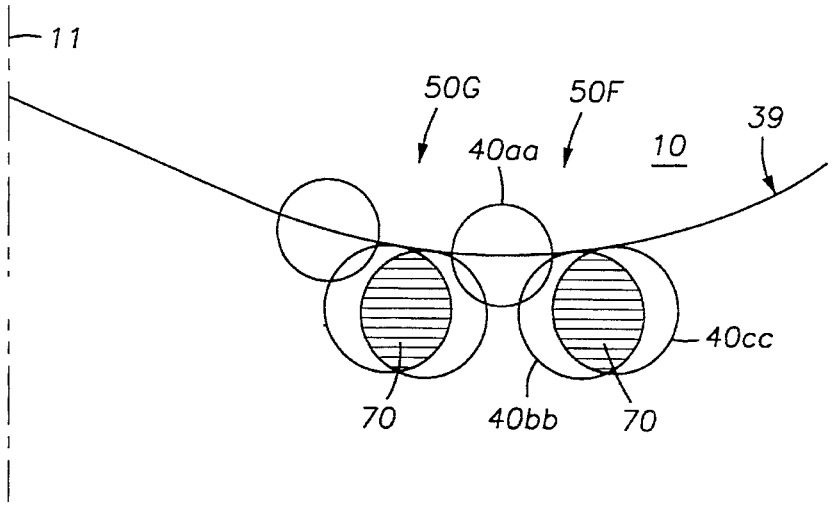

Although various preferred embodiments of the invention have thus far been described, it is to be understood that the invention is not limited to the particular type, size, shape or spacing of the cutter elements described above. For example, referring to FIG. 8, the size of the cutter elements within a given set 50 may differ. Shown in FIG. 8 is set 50F comprising low profile cutter 40*aa* and a pair of high profile cutters, 40*bb*, 40*cc*. Cutters 40*aa–cc* are identical to cutters 40 previously described with reference to FIGS. 5–7, except that their relative sizes differ. More specifically, the diameter of low profile cutter element 40*aa* is approximately three-fourths the diameter of the cutting faces of cutters 40*bb* and 40*cc*. In this embodiment, cutter element 40*aa* may have a cutting face ¾inch in diameter while cutters 40*bb* and 40*cc* each include a cutting face 1 inch in diameter. The cutting profile of high profile cutter element 40*bb*, 40*cc* combine to define a region of maximum diamond density 70 for set 50F. A relatively small low profile cutter such as cutter 40*aa* may be used to more closely position the maximum density regions 70 of adjacent sets 50. Similarly, employing relatively large high profile cutter elements as compared to the low profile cutter element 40 tens to create larger high profile regions of maximum diamond density 70 useful for providing increased bit stability.

Figure 9:
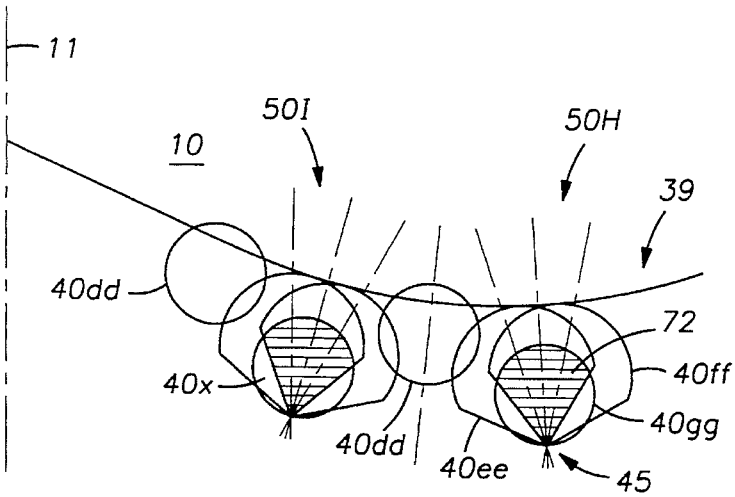
FIGS. 6–9 are views similar to FIG. 5 showing alternative embodiments of the present invention having alternative arrangements of the cutter elements.

As mentioned above, the present invention is not limited to any particular shape of cutter element 40 or cutting face 44. Referring to FIG. 9, another preferred embodiment of the invention is shown in which pointed or scribe shaped cutters are employed. Shown in FIG. 9 are adjacent cutter sets 50H, 501. Each cutter set 50H,I includes a low profile, round faced cutter element 40*dd* and three high profile cutter elements 40*ee–gg*. Cutter elements 40*ee* and 40*ff* are scribe cutters having a pointed cutting profile and a cutting tip 45 at the end of the cutter most exposed to the formation material. Additionally, each set 50H,I includes a high profile cutter element 40*gg* which includes a generally circular cutting profile. Cutters 40*ee–gg* are arranged on different blades 31–36 of bit 10 and positioned such that the cutting profile of circular cutter 40*gg* is aligned with cutting tips 45 on scribe cutters 40*ee*, 40*ff*. Such an arrangement presents a very well-defined and generally pointed high profile region of maximum diamond density indicated generally by reference numeral 72. Once again, sets 50H, 501 may include redundant cutters to cutter elements 40*dd–40 gg*, such redundant cutters obviously increasing the diamond density throughout the set cutting profile.

While the preferred embodiments of the invention have been shown and described, modifications thereof can be made by one skilled in the art without departing from the spirit and teachings of the invention. The embodiments described herein are exemplary only, and are not limiting.

Many variations and modifications of the invention and the principles disclosed herein are possible and are within the scope of the invention. Accordingly, the scope of protection is not limited by the description set out above, but is only limited by the claims which follow, that scope including all equivalents of the subject matter of the claims.

What is claimed is:

1. A cutting structure for a bit face of a fixed cutter drill bit, said cutting structure comprising:

sets of cutter elements mounted in spaced relationship on the bit face, each of said cutter sets having a set cutting profile and comprising a plurality of cutter elements having element cutting profiles, wherein each set cutting profile is defined by the rotated cutting profiles of the cutter elements in the set; and wherein a first set includes a first cutter element mounted at a first exposure height equal to X, a second cutter element mounted at a second exposure height equal to Y, and a third cutter element mounted at a third exposure height equal to Y':

wherein Y and Y' are each greater than X: and wherein said first and second cutter elements are radially spaced apart a distance equal to R; and wherein said second and third cutter elements are mounted at substantially the same radial position on said bit face, and wherein Y' is greater than Y.

2. The cutting structure of claim 1 wherein at least one of said second and said third cutter elements has a cutting profile that differs in shape from the cutting profile of said first cutter element.

3. A cutting structure for a bit face of a fixed cutter drill bit, said cutting structure comprising:

sets of cutter elements mounted in spaced relationship on the bit face, each of said cutter sets having a set cutting profile and comprising a plurality of cutter elements having element cutting profiles, wherein each set cutting profile is defined by the rotated cutting profiles of the cutter elements in the set; and wherein a first set includes a first cutter element mounted at a first exposure height equal to X, a second cutter element mounted at a second exposure height equal to Y, and a third cutter element mounted at a third exposure, height; equal to Y';

wherein Y and Y' are each greater than X; and wherein said first and second cutter elements are radially spaced apart a distance equal to R; and wherein Y' is substantially the same as Y, and wherein said first and third cutter elements are radially spaced apart a distance equal to R', and wherein R' is greater than R; and wherein said cutting face of said second cutter element differs in shape from said cutting face of said third cutter element.

4. The cutting structure of claim 2 wherein said second cutter element has a cutting face that differs in shape from the cutting face of said first cutter element.

5. The cutting structure of claim 3 wherein said second and third cutter elements have cutting faces that are pointed and have cutting tips at the end of the cutter elements furthest from said bit face.

6. The cutting structure of claim 5 wherein said cutting tips of said cutting faces of said second and third cutter elements are substantially aligned when viewed in rotated profile.

7. The cutting structure of claim 6 wherein said first set further comprises a forth cutter element having a generally circular cutting face and positioned at an exposure height substantially the same as Y such that, in rotated profile, said cutting face of said forth cutter element is substantially aligned with said cutting tips of said second and third cutter elements.

8. A cutting structure for the bit face of a fixed cutter drill bit useful for drilling a borehole in formation material when the bit is rotated about its axis, said cutting structure comprising:

a plurality of cutter elements mounted on and protruding from the bit face, said cutter elements having cutting faces and cutting profiles for cutting kerfs through the formation material and being arranged in a plurality of spaced cutter sets, each of said sets including a set cutting profile; and wherein said cutter elements in said sets include at least two high profile cutter elements and one low profile cutter element, the cutting profile of said low profile cutting element partially overlapping with the cutting profile of at least one of said high profile cutter elements; and wherein said cutting profiles of said two high profile cutter elements are out of profile with one another; and wherein said two high profile cutter elements have cutting faces that are out of profile in a direction such that a first of said high profile elements is more exposed to the formation material than a second of said high profile elements.

9. The cutting structure of claim 8 wherein said first high profile cutter elements has an exposure height that exceeds the exposure height of said low profile cutter element by at least 0.02 inch; and wherein said second of said high profile cutter elements has an exposure variance with respect to said first high profile cutter element of at least 0.02 inches.

10. The cutting structure of claim 8 wherein said high profile elements are out of profile with respect to one another by at least 0.02 inches.

11. A cutting structure for the bit face of a fixed cutter drill bit useful for drilling a borehole in formation material when the bit is rotated about its axis, said cutting structure comprising:

a plurality of cutter elements mounted on and protruding from the bit face, said cutter elements having cutting faces and cutting profiles for cutting kerfs through the formation material and being arranged in a plurality of spaced cutter sets each of said sets including a set cutting profile: and wherein said cutter elements in said sets include at least two high profile cutter elements and one low profile cutter element, the cutting profile of said low profile cutting element partially overlapping with the cutting profile of at least one of said high profile cutter elements; and wherein said cutting profiles of said two high profile cutter elements are out of profile with one another; and wherein said two high profile cutter elements are mounted at substantially the same exposure height relative to the formation material but mounted at different distances from the bit axis; and wherein at least one of said two high profile cutter elements has a cutting profile that is noncircular.

12. The cutting structure of claim 11 wherein said first and second high profile elements are out of profile with respect to another by at least 0.05 inches.

13. The cutting structure of claim 11 wherein at least one of said high profile cutter elements has a pointed cutting profile.

14. The cutting structure of claim 13 wherein said first and second high profile cutter elements have cutting profiles that at least partially overlap in rotated profile.

15. A fixed cutter drill bit for drilling through formation material when said bit is rotated about its axis, said drill bit comprising:

a bit body including a bit face having a plurality of radially disposed blades angularly spaced from one another;

cutter elements disposed in rows on said blades, said rows including a plurality of cutter elements radially spaced from each other relative to the bit axis, said cutter elements in said rows having cutting faces with cutting profiles for cutting formation material;

wherein said cutter elements in said rows are arranged in sets, each of said sets comprising a first cutter element on a first blade, a second cutter element on a second blade, and a third cutter element on a third blade; and wherein said first and said second cutter elements are mounted at differing radial positions relative to the bit axis and at differing exposure heights, said first cutter element having an exposure height equal to X and said second cutter element having an exposure height equal to Y, wherein Y is greater than X; and wherein said first and said third cutter elements are mounted at differing radial positions relative to the bit axis and at differing exposure heights, said third cutter element having an exposure height equal to Y', wherein Y' is greater than X; and wherein Y' is greater than Y and wherein said second and third cutter elements are mounted at substantially the same radial position.

16. A fixed cutter drill bit for through formation material when said bit is rotated about its axis, said drill bit comprising:

a bit body including a bit face having a plurality of radially disposed blades angularly spaced from one another;

cutter elements disposed in rows on said blades, said rows including a plurality of cutter elements radially spaced from each other relative to the bit axis, said cutter elements in said rows having cutting faces with cutting profiles for cutting formation material;

wherein said cutter elements in said rows are arranged in sets, each of said sets comprising a first cutter element on a first blade, a second cutter element on a second blade, and a third cutter element on a third blade; and wherein said first and said second cutter elements are mounted at differing radial positions relative to the bit axis and at differing exposure heights, said first cutter element having an exposure height equal to X and said second cutter element having an exposure height equal to Y, wherein Y is greater than X; and wherein said first and said third cutter elements are mounted at differing radial positions relative to the bit axis and at differing exposure heights, said third cutter element having an exposure height equal to Y', wherein Y' is greater than X; and wherein Y' is substantially equal to Y, and wherein said second and third cutter elements are positioned on the bit face at differing radial locations; and wherein at least one of said second and third cutter elements have a noncircular cutting profile.

17. The drill bit of claim 16 wherein said second and third cutter elements are scribe cutters having pointed cutting tips, and wherein said pointed cutting tips are aligned with each other when viewed in rotated profile.

18. The drill bit of claim 16 wherein said set includes at least one round cutter element having a generally circular shaped cutting profile and at least one scribe cutter element having a cutting profile that includes a cutting tip, and wherein the edge of said cutting profile of said round cutter is aligned with said cutting tip of said scribe cutter when viewed in rotated profile.

19. The drill bit of claim 16 wherein said cutting profiles of said cutter elements in a first of said sets have a different shape than said cutting profiles of said cutter elements of a second of said sets.

20. The drill bit of claim 16 wherein said cutter elements of at least one of said sets include cutter elements having cutting profiles of differing shapes.

21. The drill bit of claim 16 wherein the number of cutter elements in adjacent sets increases upon moving in a radial direction away from the bit axis.

22. The drill bit of claim 16 wherein said sets are more closely spaced in the shoulder portion of the bit face than in the central portion.

* * * * *